US011264759B1

(12) United States Patent
Sundarakrishnamachari et al.

(10) Patent No.: US 11,264,759 B1
(45) Date of Patent: Mar. 1, 2022

(54) CONNECTOR WITH INTEGRATED PRIMARY LOCK REINFORCEMENT AND TERMINAL POSITION ASSURANCE

(71) Applicant: Aptiv Technologies Limited, St. Michael (BB)

(72) Inventors: Rangarajan Sundarakrishnamachari, Chennai (IN); Abhaya Kishore, Nagercoil (IN)

(73) Assignee: APTIV TECHNOLOGIES LIMITED

( * ) Notice: Subject to any disclaimer, the term of this patent is extended or adjusted under 35 U.S.C. 154(b) by 3 days.

(21) Appl. No.: 16/995,419

(22) Filed: Aug. 17, 2020

(51) Int. Cl.
*H01R 13/627* (2006.01)
*H01R 24/28* (2011.01)
*H01R 4/70* (2006.01)

(52) U.S. Cl.
CPC ..... *H01R 13/6273* (2013.01); *H01R 4/70* (2013.01); *H01R 24/28* (2013.01)

(58) Field of Classification Search
CPC ..... H01R 13/4362; H01R 13/4361; H01R 13/6273; H01R 24/28; H01R 4/70
USPC ..... 439/752, 595
See application file for complete search history.

(56) References Cited

U.S. PATENT DOCUMENTS

| | | | | |
|---|---|---|---|---|
| 5,743,761 | A * | 4/1998 | Kawase | B29C 45/006 439/595 |
| 6,783,396 | B1 * | 8/2004 | Osterhart | H01R 13/521 439/587 |
| 10,079,446 | B1 * | 9/2018 | Sundarakrishnamachari | H01R 13/4364 |
| 2008/0261425 | A1 * | 10/2008 | Nakamura | H01R 13/5812 439/188 |
| 2012/0196465 | A1 * | 8/2012 | Stausser | H01R 13/5219 439/282 |
| 2019/0006782 | A1 * | 1/2019 | Vasbinder | H01R 13/631 |
| 2019/0199036 | A1 * | 6/2019 | Kanemura | H01R 24/40 |
| 2020/0021054 | A1 * | 1/2020 | Maesoba | H01R 13/4361 |
| 2020/0044379 | A1 * | 2/2020 | Miyamura | H01R 13/4368 |
| 2020/0203877 | A1 * | 6/2020 | Ohfuku | H01R 13/4362 |

* cited by examiner

*Primary Examiner* — Gary F Paumen
(74) *Attorney, Agent, or Firm* — Billion & Armitage

(57) ABSTRACT

A connector assembly comprises a resilient primary lock for securing a wire terminal with a housing, a primary lock reinforcement (PLR) device, and a PLR actuator for moving the PLR device between pre- and fully-staged configurations. The PLR device is configured to move in response to contact by the PLR actuator as the housing components are mated together. The PLR actuator includes an elongated, tapered finger that wedges against the PLR device during housing mating. A method of reinforcing a primary lock of a connector assembly is also described.

26 Claims, 10 Drawing Sheets

CONNECTOR WITH INTEGRATED PRIMARY LOCK REINFORCEMENT AND TERMINAL POSITION ASSURANCE

FIELD

This disclosure is generally directed to the art of electrical connectors and, more particularly, to an electrical connector assembly which includes primary lock reinforcement and terminal position assurance features.

BACKGROUND

A common type of electrical connector includes a dielectric housing having a plurality of terminal-receiving cavities within which are mounted a plurality of terminals. The terminals typically terminate an insulated wire and may be formed metal components. The terminals include a mating end for mating with terminals of a complementary electrical connector assembly. The terminals must be properly positioned within their respective housing cavities for proper mating with the terminals of the complementary connector assembly, usually with a primary lock structure. In some cases, primary lock components fail to retain or align the terminals particularly in high vibration or large current load environments. Another shortcoming of present primary lock designs is failure during assembly from relatively high insertion forces during connection. It would be desirable to remedy these deficiencies.

SUMMARY

According to one aspect, an electrical connector is provided with integrated primary lock reinforcement and terminal position assurance (TPA) features.

According to one aspect, an electrical connector is provided with integrated primary lock reinforcement (PLR) and terminal position assurance (TPA) features. The PLR is secured within a first housing and includes a blocking projection, with the PLR being constrained to prevent movement in a longitudinal (mating) direction while allowing movement in a lateral direction. A PLR actuator is carried by a second housing and engages and moves the PLR device in the lateral direction between pre- and fully-staged configurations.

According to another aspect, a PLR actuator includes an elongated finger providing a wedging action to move the PLR device as the housings are brought together.

According to another aspect, a method of reinforcing a primary lock includes providing a deflectable primary lock for securing a first wire terminal within a first housing having a PLR device with blocking projections. When a second housing is connected to the first housing a PLR actuator is wedged against the PLR device, and moving it in a lateral direction. A blocking projection is thus laterally moved into position to reinforce against primary lock deflection.

DETAILED DESCRIPTION

Figure 1:
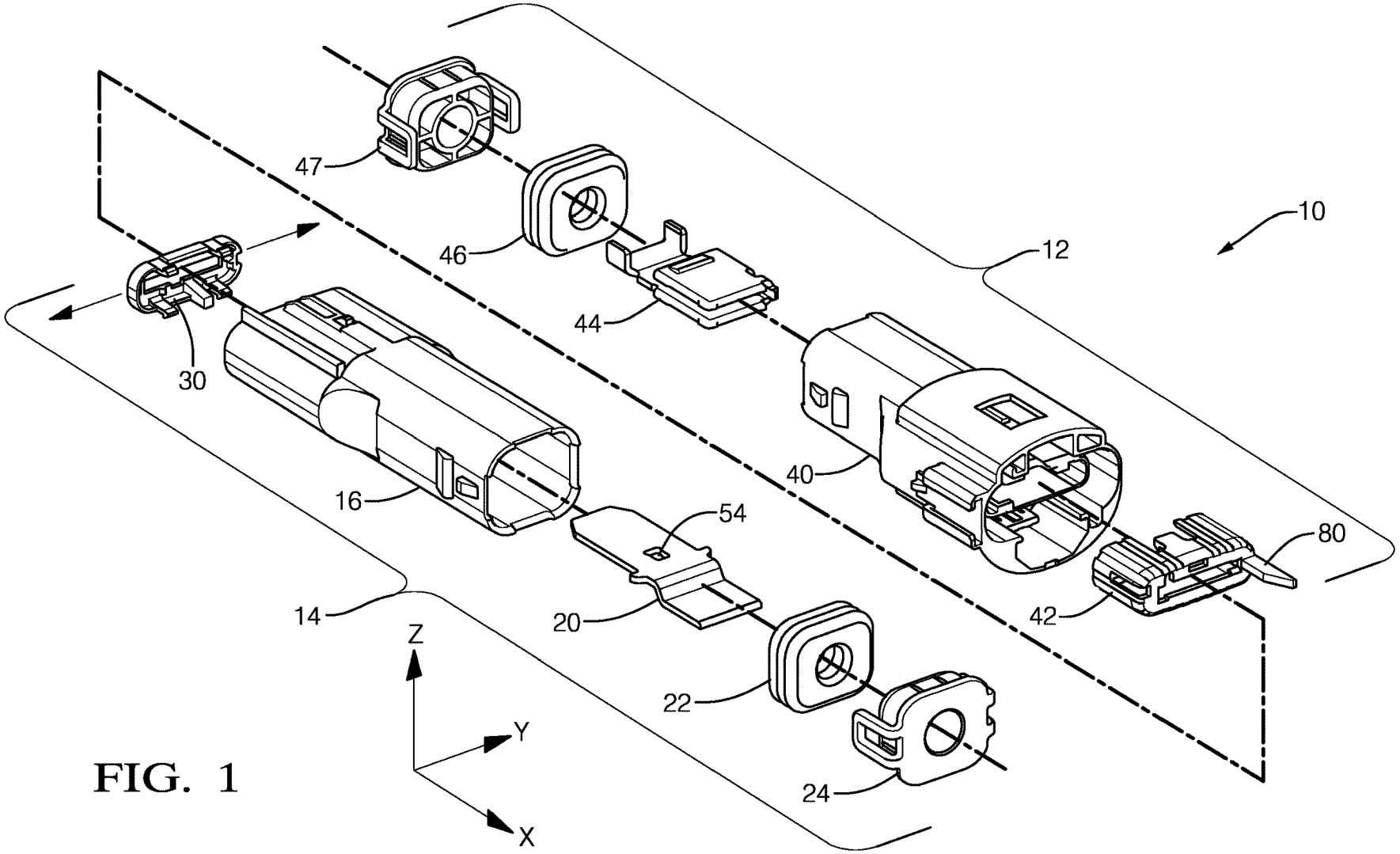
FIG. 1 is an exploded view of a connector assembly according to some embodiments.

According to one aspect, this disclosure is directed to a connector assembly and method of utilizing the connector assembly to provide primary lock reinforcement and terminal position assurance features.

The present teachings are directed toward a connector assembly with primary lock reinforcement (PLR) and terminal position assurance (TPA) features to ensure terminal components are properly positioned during assembly and remain properly positioned and secured during intended use. The present teaching is directed to a connector assembly having a PLR feature that maintains terminal position by reinforcing the primary terminal lock and a TPA feature that generally acts to prevent assembly of the connector assembly in the event the terminal is partially installed or not fully seated.

In the automotive industry, high power electrical connectors are widely used to transmit power between different systems including the battery assembly, starter motor, power assist and wheel motors of electric or hybrid vehicles. Improper installation of electrical connectors has long been a problem in mating connector assemblies. The mating assemblies may perform quite adequately under normal circumstances, but open circuits or other defects can occur when the terminals are not properly positioned within the housings of the connector assemblies or when the assemblies are not properly mated. In addition, use of the connectors in vibration environments can cause the terminals to become loosened and rendered defective. In many environments improper retention of the terminals can result in unstable electrical interconnections which can be difficult to detect or diagnose.

Various designs have been used to improve the retention of terminals within electrical connector housings and to improve the mating integrity of the connector assemblies themselves. For example, terminal latches integral with the connector housing often are used to enhance the mating integrity between the connectors. Regardless of the integrity between the connector housings themselves, if the terminals are improperly positioned within each housing, open circuits or terminal damage can occur even though the connector housings appear to be properly mated. Therefore, various devices have been designed to protect against improperly positioned terminals and, in fact, to prevent the connector assemblies from mating unless all of the terminals therewithin are properly positioned. Such devices commonly have been called "terminal position assurance" (TPA) devices. Typical TPAs are intended to be activated, or moved into their final position, after the terminals are assembled into the housing. Traditionally, these connectors are shipped in bulk to the end user, where the wire harnesses are made, wires crimped to the terminals, and terminals inserted into the housing cavities. Thereafter, the TPA member is moved into the final position.

Embodiments of the present disclosure generally provide for a connector assembly and methods of use. All references to the connector assembly components and the functionality provided by each, are not intended to be limited to encompassing only what is illustrated and described herein. While particular labels may be assigned to the various structures disclosed, such labels are not intended to limit the scope of operation for the connector assembly.

In general terms, the connector assembly can couple with a mating connector to allow for the transfer of electrical signals therebetween, such as for transferring power and/or information signals for example. While electrical terminals are described, it is also contemplated that the terminals and any cables connected thereto may be capable of transferring information in other ways, such as through fiber optic connections for example.

A first exemplary embodiment of a connector assembly 10 including primary lock reinforcement (PLR) and terminal position assurance (TPA) of the present invention is hereinafter described with reference the Figures. For simplicity of the description of the present invention, the connector assembly 10 extends along and about a longitudinal X axis which defines a longitudinal direction (the mating direction), a lateral axis Y defines a lateral direction and a transverse axis Z defines a transverse direction. The longitudinal axis X, the lateral axis Y and the transverse axis Z perpendicularly intersect one another to form a conventional Cartesian coordinate system.

FIG. 1 is an exploded perspective view of a connector assembly 10 having a female connector 12 and a male connector 14. Male connector 14 includes a male housing 16 having an end adapted to be inserted into the open entrance of the female connector 12 of the connector assembly. A male wire terminal, hereinafter referred to as the male terminal 20 is held within the male housing 16 and is adapted to be connected to a first wire (not shown). The wire exits the male housing 16 by passing through a wire seal 22 and seal retainer 24. The male connector 14 of the connector assembly 10 contains a sliding primary lock reinforcement (PLR) 30. As described in greater detail hereinafter, PLR 30 is slidably held within the male housing 16 and constrained to move in the lateral directions between pre-staged and fully staged configurations to provide a primary lock reinforcement.

Female connector 12 of connector assembly 10 includes a female housing 40 containing a PLR actuator 42 and a female wire terminal, hereinafter referred to as the female terminal 44 adapted to be connected to a second wire (not shown). The second wire exits the female housing 40 by passing through a wire seal 46 and seal retainer 47. The PLR actuator 42 engages PLR 30 with a wedging action to move the PLR 30 between pre-staged and fully staged configurations.

Figure 2:
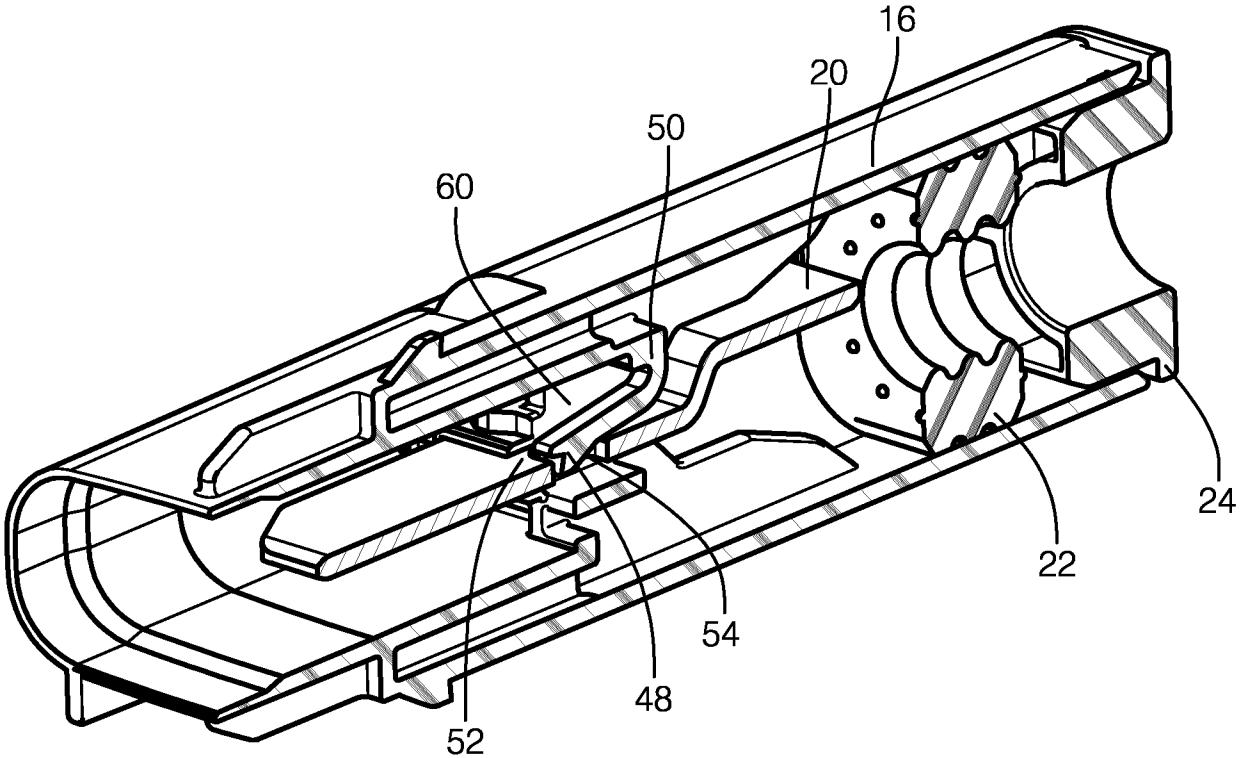
FIG. 2 is a cross-sectional view of a portion of the connector assembly of FIG. 1 according to some embodiments.

FIG. 2 is a cross-sectional view of the male connector 14 of connector assembly 10 taken along a longitudinally-directed plane. The deflectable primary lock 48 is a resilient, cantilevered deflectable beam having a proximal end 50 attached to the male housing 16 and a free distal end 52 engaging an aperture 54 of male terminal 20 in order to secure the male terminal 20 within the male housing 16. The primary lock 48 deflects when the male terminal 20 is inserted into the male housing 16 and then returns to engage the aperture 54 at distal end 52 when the male terminal 20 is properly positioned. A "deflection zone" 60 is generally defined as the region between the primary lock 48 and the male housing 16 into which the primary lock 48 deflects, such as when the male terminal 20 is inserted into the male housing 16 or retracted from the male housing 16. Under certain high load forces, a primary lock of a prior art connector assembly may buckle and collapse into the deflection zone and inadvertently release a terminal from the housing. As described in greater detail hereinafter, the primary lock reinforcement (PLR) 30 selectively positions a blocking projection 72 (shown in FIG. 3) into the deflection zone 60 to reinforce the primary lock 48 and prevent unintended movement of the primary lock 48.

Figure 3:
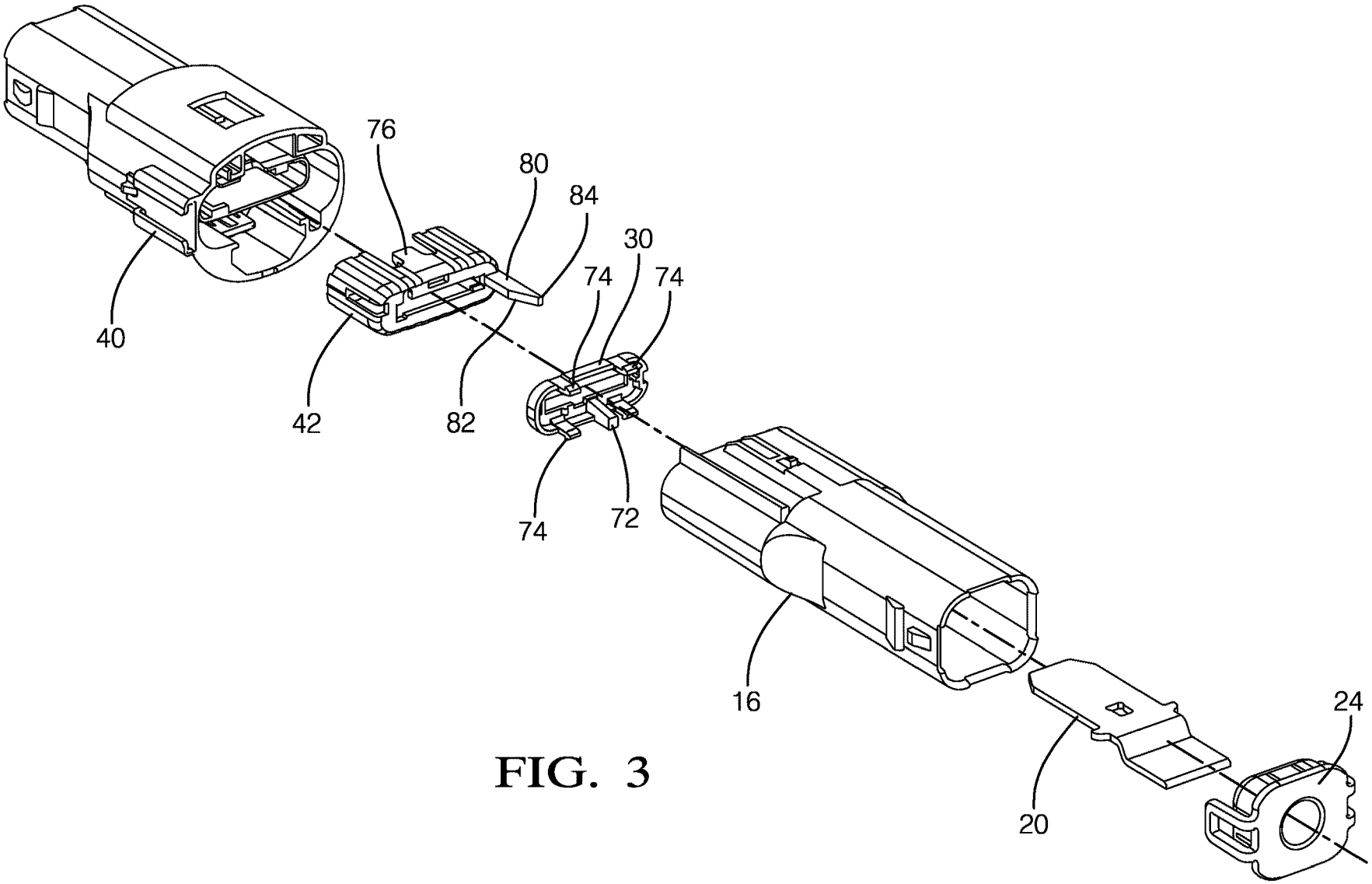
FIG. 3 is an exploded view a portion of the connector assembly of FIG. 1 according to some embodiments.

FIG. 3 is a detailed, partial perspective view of the connector assembly 10 of FIG. 1. Primary lock reinforcement (PLR) 30 includes four flexible securing latches 74 for connecting the PLR 30 within male housing 16. The securing latches 74 engage with male housing 16 and permit the PLR 30 to slide laterally within the male housing 16. The blocking projection 72 is sized to be selectively received into the primary lock deflection zone 60 during a final stage configuration to provide reinforcement against buckling or deflection of the primary lock 48 under high load conditions, such as terminal assembly.

Figure 8:
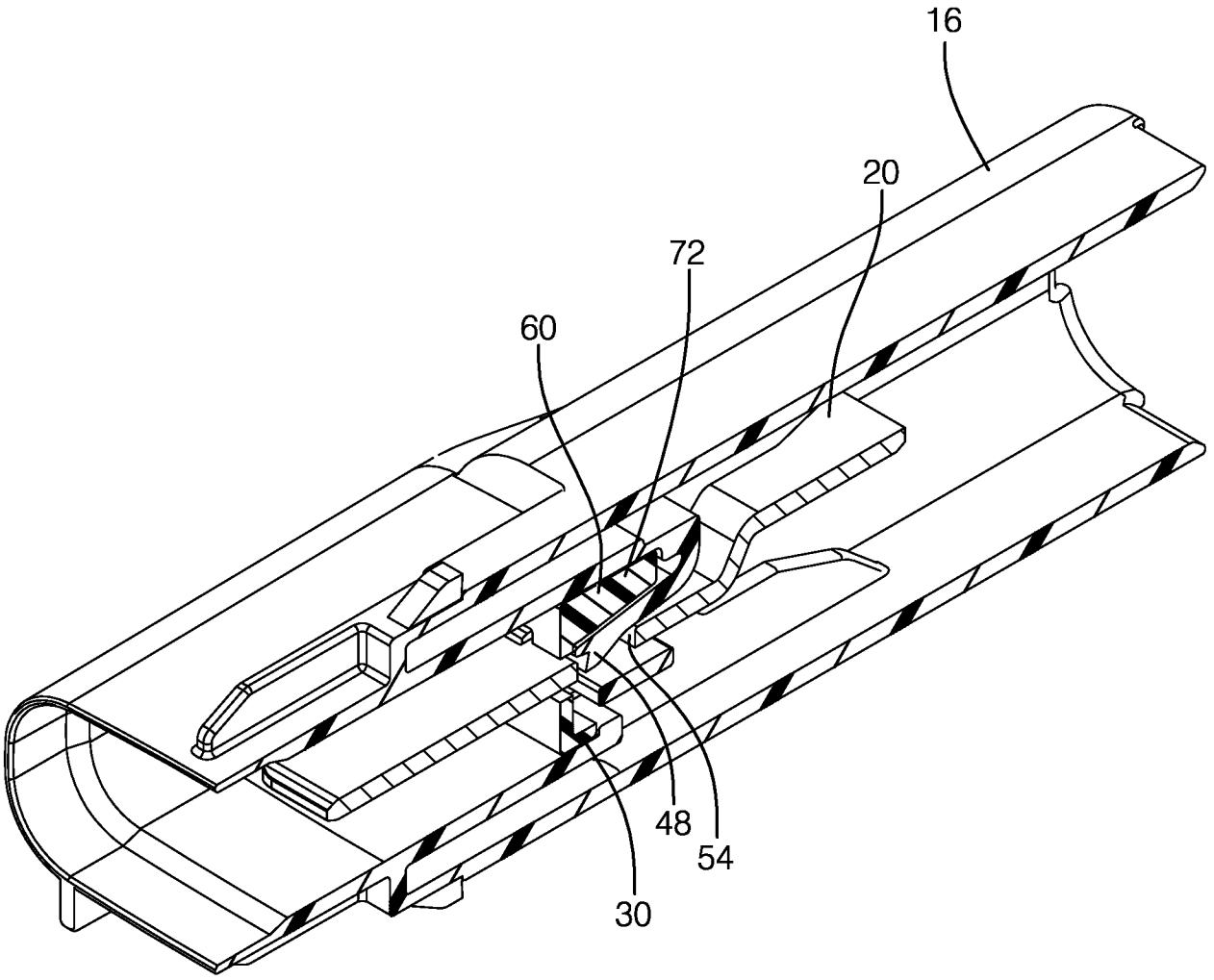
FIG. 8 is a perspective view of a cross-section of the connector assembly of FIG. 1 according to some embodiments.

PLR actuator 42 is retained in a substantially fixed relationship within the female housing 40 via a resilient latch structure 76. PLR actuator 42 includes an elongated indexing finger 80 which engages PLR 30 as the connector 10 is assembled. Indexing finger 80 includes an inclined surface 82 defining a generally tapering end 84 for the indexing finger 80. Engagement of indexing finger 80 with PLR 30 causes PLR 30 to slide laterally within the male housing 16. The lateral movement of PLR 30 causes the blocking projection 72 to slide into the deflection zone 60 (as shown in FIG. 8) to provide reinforcement against buckling or deflection of the primary lock.

Figure 4:
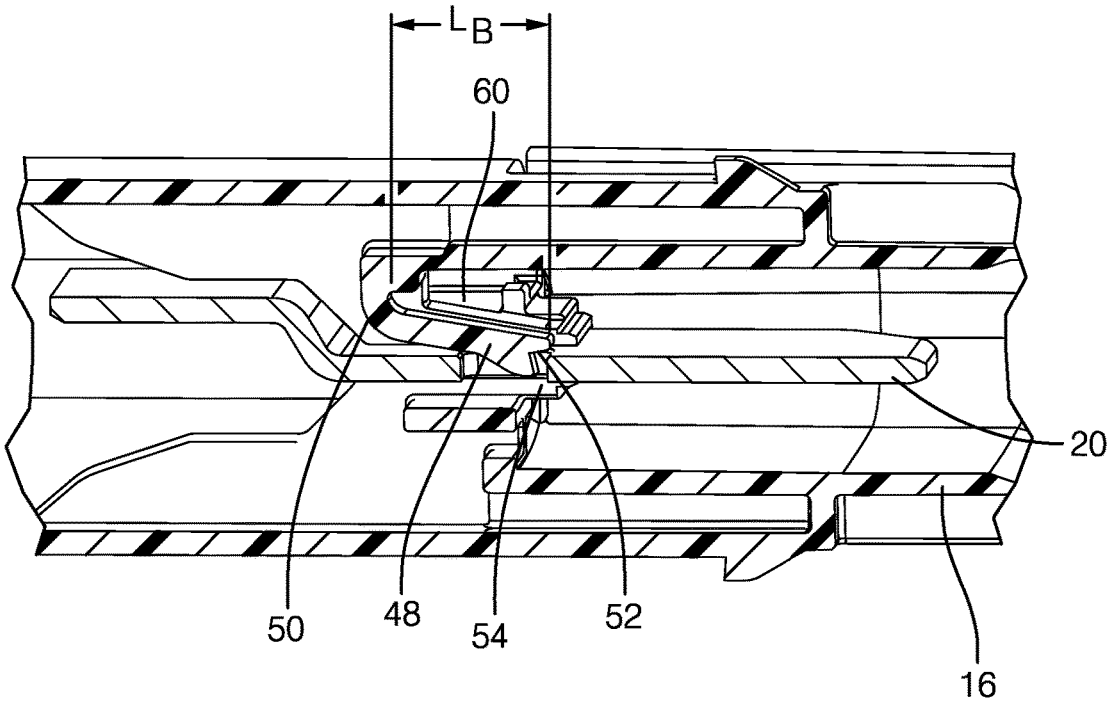
FIG. 4 is a cross-sectional view of the connector assembly of FIG. 1 according to some embodiments.

FIG. 4 is a detailed portion of FIG. 2 showing a projected length, $L_b$, of the primary lock 48. In one embodiment of the present invention (as shown in FIG. 8) the blocking projection 72 occupies the deflection zone 60 with a length dimension of 60% of $L_b$ or more. In other words, the blocking projection 72 has a length (measured in the longitudinal direction) of at least 0.60 $L_b$ in one embodiment of the present invention. As shown in detail in FIG. 4, primary lock 48 is allowed to deflect within the deflection zone 60 during installation of male terminal 20. When fully inserted the distal end 52 of primary lock 48 engages with aperture 54 of male terminal 20 to secure the male terminal 20 within the male housing 16. As described in more detail with respect to FIG. 8, the PLR 30 slides laterally to selectively position the blocking projection 72 within the deflection zone 60 to reinforce the primary lock 48 and prevent unintended movement of the primary lock 48.

Figure 5:
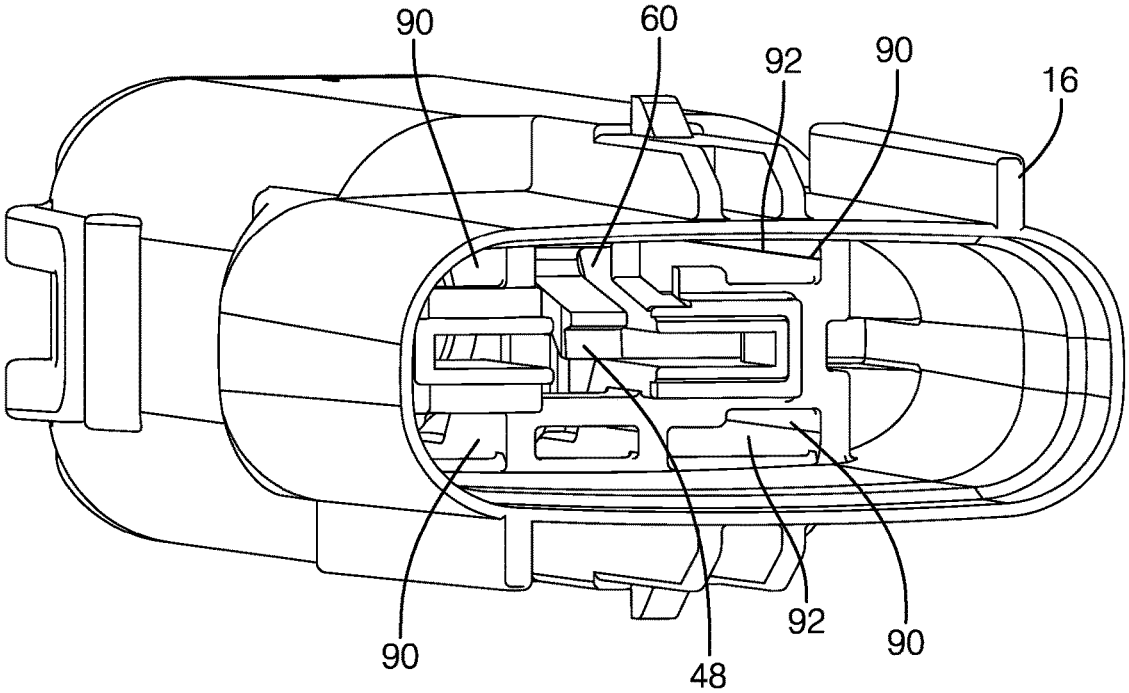
FIG. 5 is a perspective view of the male housing of FIG. 1 according to some embodiments.

FIG. 5 is a perspective view of the male housing 16 showing four generally L-shaped elongated slots 90 positioned around the primary lock 48 for receiving the securing latches 74 of PLR 30. Each L-shaped elongated slot 90 includes an enlarged end portion 92 positioned toward one of the sides of male housing 16. The entrances to the L-shaped slots 90 are aligned in a generally lateral (orthogonal) plane relative to the mating direction to limit movement of the PLR 30 in a lateral direction. Having received the securing latches 74 of PLR 30, the L-shaped elongated slots 90 allow the PLR 30 to slide laterally away from the enlarged end portion 92 and toward a narrow portion opposite the enlarged end portions 92. The lateral movement of PLR 30 causes blocking projection 72 to be positioned within the deflection zone 60, thereby reinforcing the preventing subsequent deflection of primary lock 48.

Figure 6:
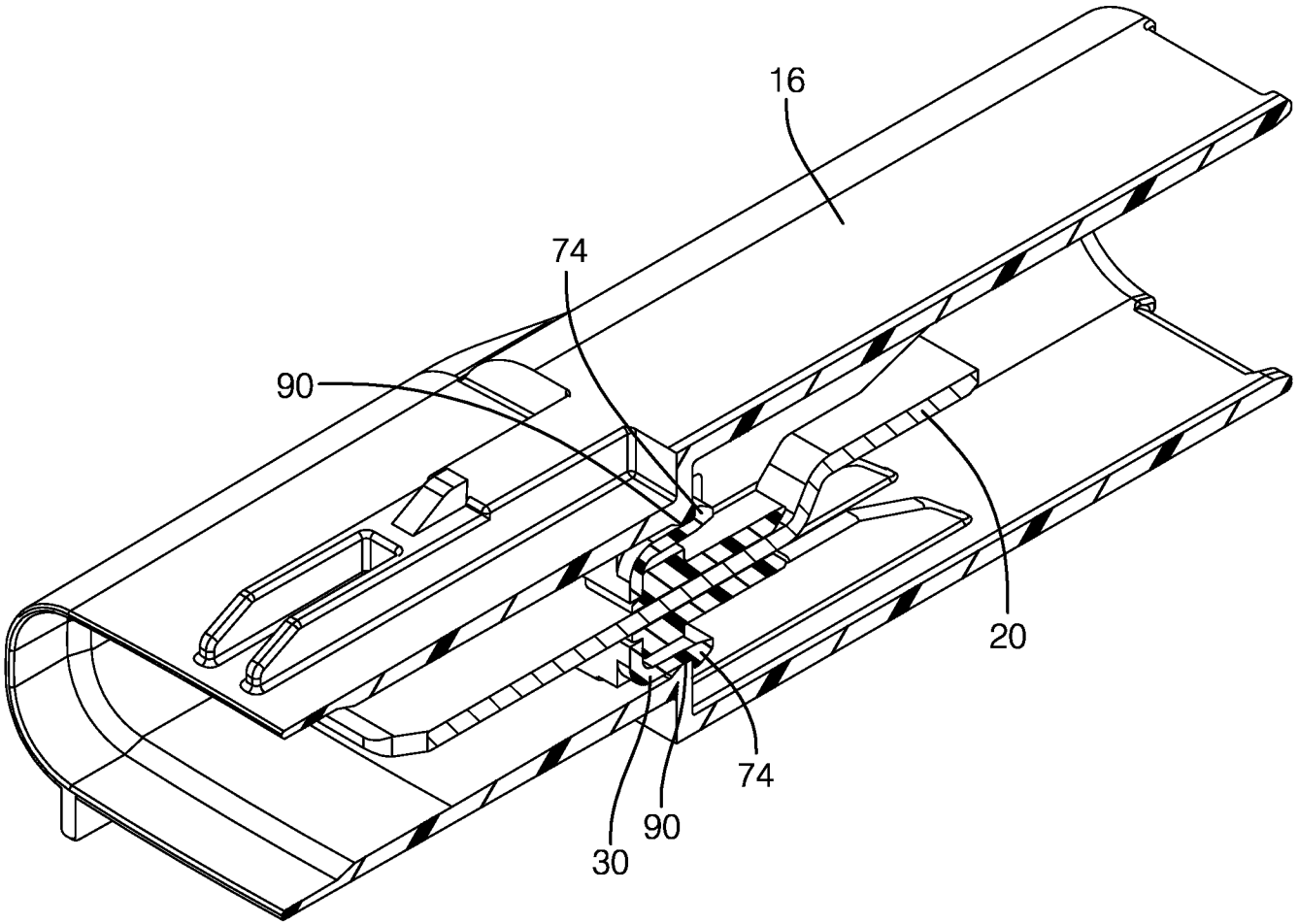
FIG. 6 is a cutaway view of the connector assembly of FIG. 1 according to some embodiments.

FIG. 6 is a cross-sectional view of the male connector 14 taken along a plane in the mating direction and offset from the centerline of male housing 16. The primary lock 48 is not visible as it is blocked from view by the male housing 16. The securing latches 74 are received into L-shaped elongated slots 90 and retain the PLR 30 within the male housing 16. The securing latches 74 slide laterally along L-shaped elongated slots 90 to impart a lateral motion to the blocking projection 72 between pre-staged and fully staged configurations.

Figure 7:
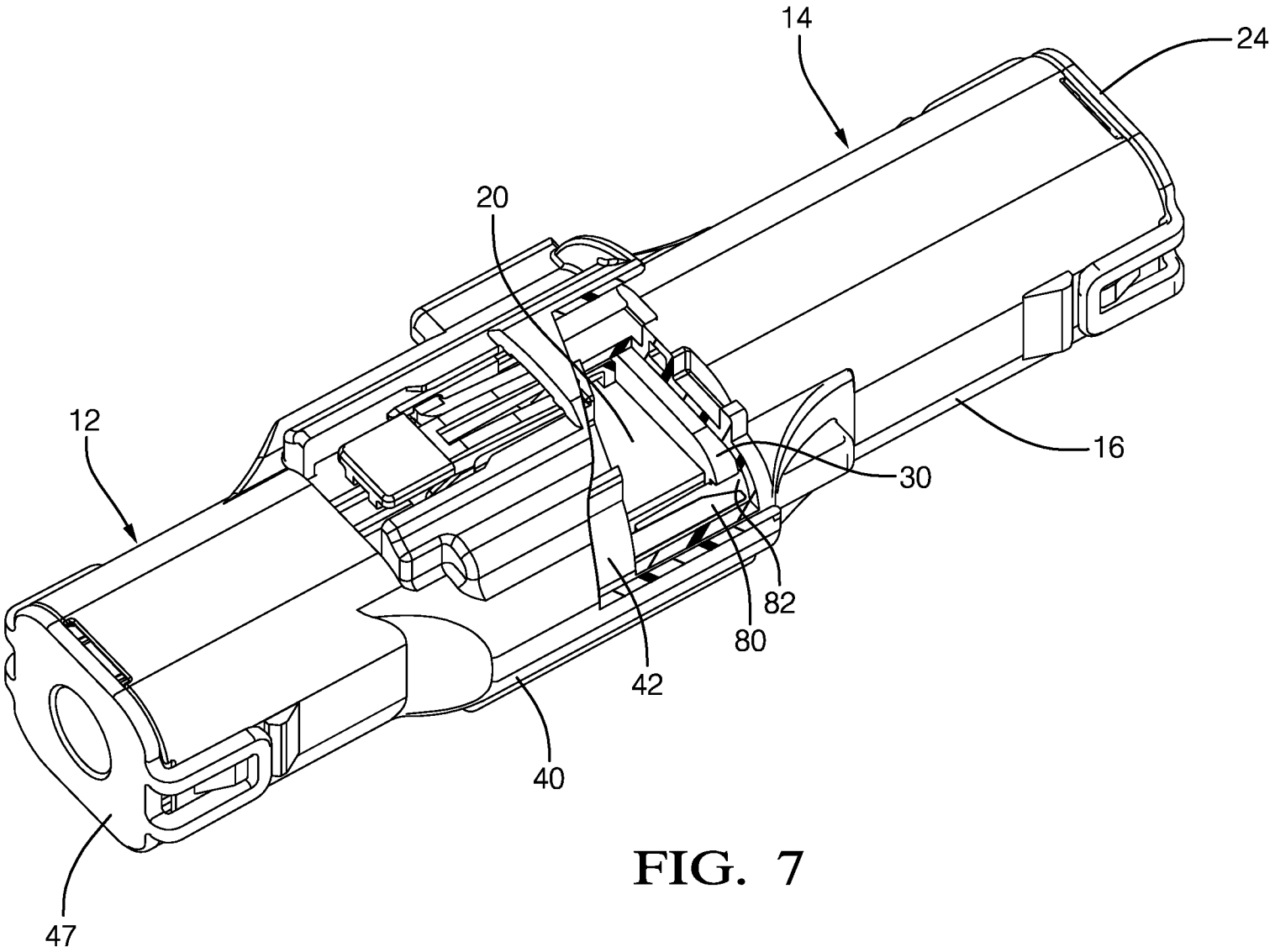
FIG. 7 is a perspective view of the connector assembly of FIG. 1 according to some embodiments.

FIG. 7 is a perspective view of the connector assembly 10 in a pre-staged configuration. A portion of male housing 16 and female housing 40 have been cut away to expose the male terminal 20, PLR 30, PLR actuator 42, indexing finger 80 and inclined surface 82. As depicted, the indexing finger 80 has initiated lateral movement of PLR 30 as the inclined surface 82 begins to wedge the PLR 30 laterally.

FIG. 8 is a cross-sectional view of portions of the male connector 14. FIG. 8 depicts components of the male connector in a final-stage configuration with the blocking projection 72 substantially occupying the deflection zone 60 to provide reinforcement against deflection of the primary lock 48.

Figure 9:
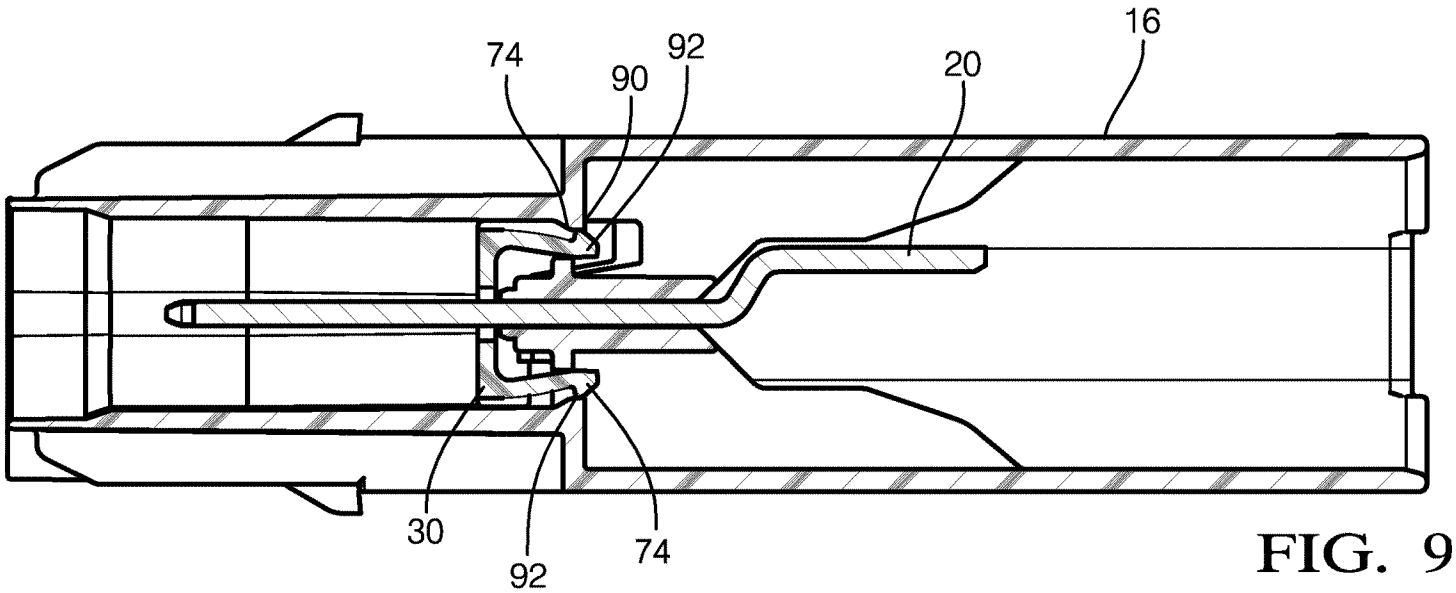
FIG. 9 is a side view of a cross-section of the connector assembly of FIG. 1 according to some embodiments
Figure 10:
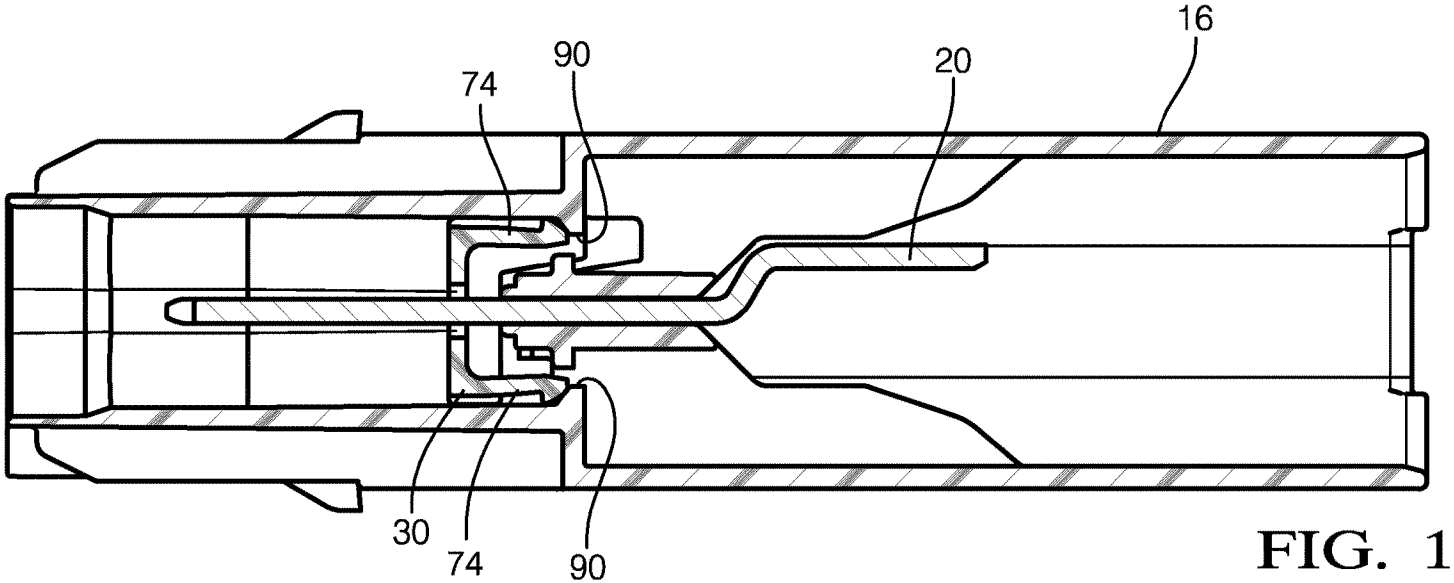
FIG. 10 is a side view of a cross-section of the connector assembly of FIG. 1 according to some embodiments

Referring now to FIGS. 9 and 10, the L-shaped elongated slots 90 in male housing 16 are configured to ensure that the PLR 30 is installed in a predetermined orientation relative to the male housing 16. FIG. 9 is a cross-sectional view of portions of the male connector 14 in an installation configuration with the PLR 30 positioned against a first side of the male housing 16. In the installation configuration, the securing latches 74 are aligned with the enlarged end portions 92 of the L-shaped elongated slots 90 and can pass through the L-shaped elongated slots 90 to secure the PLR 30 to the male housing 16. As depicted in FIG. 9, the securing latches 74 slightly bend to pass through the enlarged end portions 92 of the L-shaped elongated slots 90. Once the distal ends of the securing latches 74 pass through the L-shaped elongated slots 90, the securing latches 74 return to secure the PLR 30 to the male housing 16. In comparison, FIG. 10 depicts an improperly configured PLR 30 as the PLR 30 has moved laterally sideways so that the securing latches 74 are no longer aligned with the enlarged end portions 92 of the L-shaped elongated slots 90. As shown in FIG. 10, when the PLR 30 is improperly positioned, the securing latches 74 are blocked from entry through L-shaped elongated slots 90. Furthermore, if the male terminal 20 is partially installed/not fully seated, the primary lock 48 remains in a deflected position and restricts lateral movement of the PLR 30 toward the fully staged position. In this manner, the PLR 30 provides for terminal position assurance as the PLR 30 ensures a partially seated male terminal 20 is properly detected by the installer during assembly.

Figure 11:
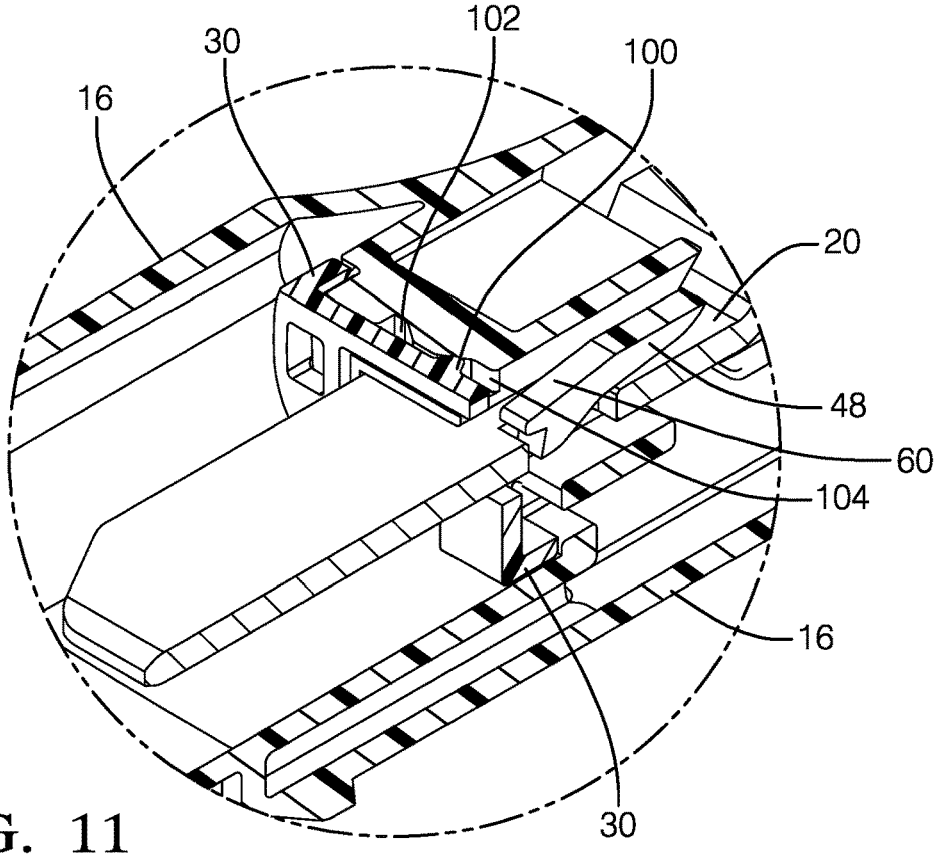
FIG. 11 is a cross-sectional perspective view of the connector assembly of FIG. 1 according to some embodiments.
Figure 12:
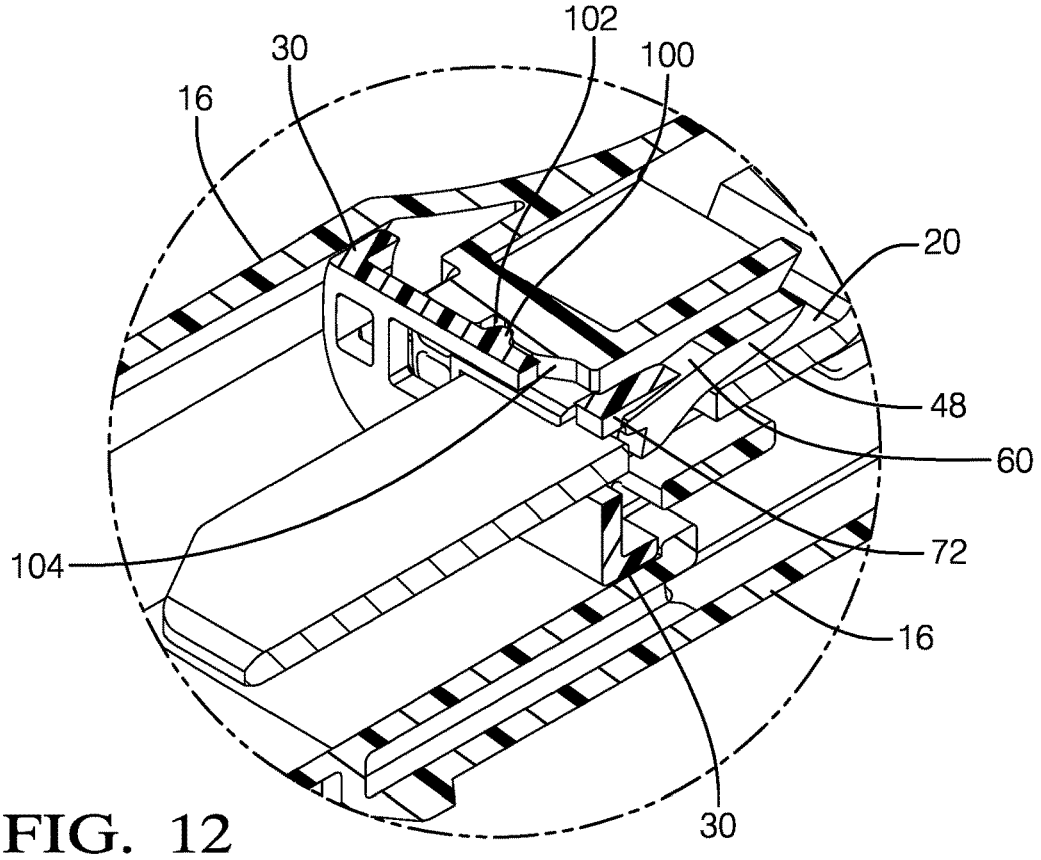
FIG. 12 is a cross-sectional perspective view of the connector assembly of FIG. 1 according to some embodiments.

FIGS. 11 and 12 depict movement of PLR 30 from pre-staged to fully staged position. The movement of PLR 30 from pre-staged (FIG. 11) to fully staged (FIG. 12) is controlled by a locking bump 100 which transitions between detent positions 102, 104. The locking bump 100 is maintained with slight interference with the male housing 16 at both pre-staged and fully staged positions to prevent rattling or other movement of the PLR 30 under high vibrations. A portion of blocking projection 72 is visible in FIG. 12 within the deflection zone 60.

Figure 13A:
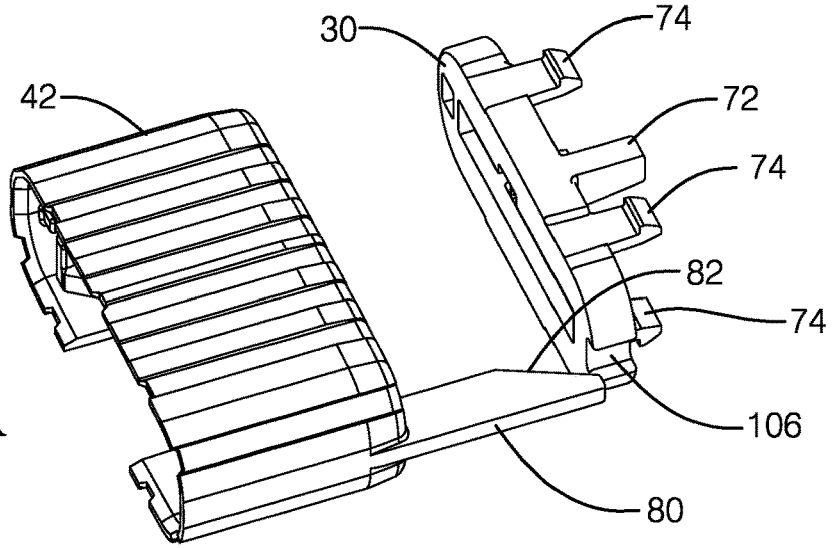
FIGS. 13A, B and C are perspective views of the PLR and PLR actuator of the connector assembly of FIG. 1 depicting movement of the PLR between pre-staged and fully staged configurations.
Figure 13B:
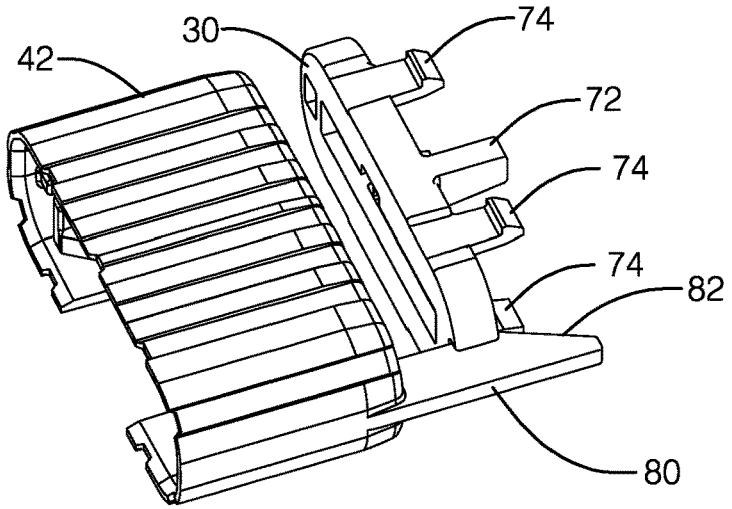
Figure 13C:
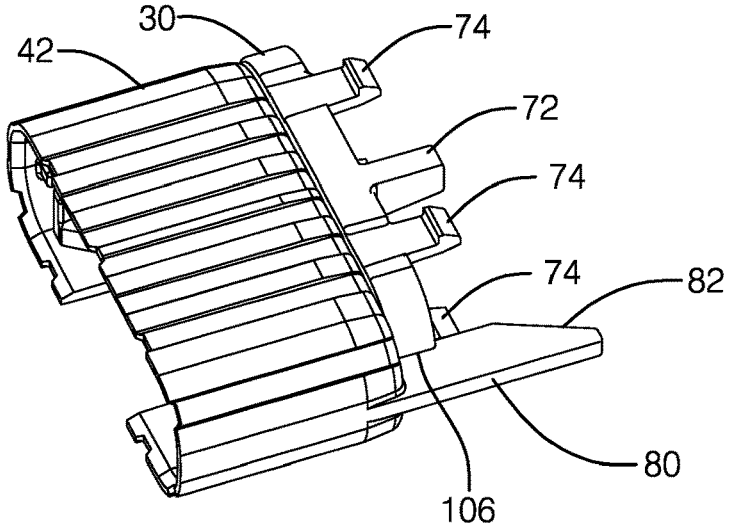

FIGS. 13A, 13B and 13C depict relative movement of the PLR 30 and PLR actuator 42 when the male connector 14 and female connector 12 are brought together. In FIG. 13A, the PLR actuator 42 and PLR 30 are depicted in a pre-staged configuration as initial contact is made between the inclined surface 82 of the indexing finger 80 and PLR 30. The indexing finger 80 is received into a side channel 106 of the PLR 30. FIG. 13B depicts further insertion of the male connector 14 into the female connector 12. The PLR 30 continues to slide laterally as contact is made between the inclined surface 82 and the PLR 30. No further lateral movement of the PLR 30 is made once the PLR 30 exits the inclined surface 82 as shown in FIG. 13B. At this point, no further lateral movement occurs as the male and female connectors 14, 12 are pushed together. FIG. 13C depicts complete insertion of the male connector 14 into the female connector 12 with a portion of the indexing finger 80 remaining within the side channel 106. FIG. 13C depicts a fully staged configuration of these connector components.

As described herein, the transition of the PLR 30 from pre-staged to fully staged configuration is controlled by the PLR actuator 42. The slope and length of the inclined surface 82 and overall length of the indexing finger 80 primarily dictate when and where the PLR 30 and PLR actuator 42 engage each other as the male and female sides of the connector assembly 10 are brought together. In general, the angle of inclined surface 82 controls the force required to move the PLR 30 to the fully staged position. A shallower angle of inclined surface 82 would result in a decrease in force required to move PLR 30 between pre-staged and fully staged configurations.

As shown in FIGS. 13A-13C, as the indexing finger 80 of PLR actuator 42 is inserted into the male housing, the inclined surface 82 engages and wedges the PLR 30 toward the fully staged configuration. In one embodiment the indexing finger 80 and inclined surface 82 are sufficiently long (along mating direction) to cause the PLR 30 to reach its final locked position before contact is made between conducting male and female terminals 20, 44. This ensures the blocking projection 72 of the PLR 30 is fully positioned to resist primary lock 48 deflection in response to high push-out forces often seen during component assembly.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

Discussion of Possible Embodiments

The following are non-exclusive descriptions of possible embodiments of the present invention.

In some aspects, a connector assembly includes a first wire terminal carried by a first housing having a mating end, with a resilient primary lock having a distal end adapted to secure the first wire terminal within the first housing, and with a primary lock reinforcement (PLR) device secured within the first housing and including a blocking projection, with the PLR device being constrained to prevent movement in a longitudinal direction while allowing movement in a lateral direction. A second wire terminal is carried by a second housing and adapted to mate with the mating end of the first wire terminal. A PLR actuator is also carried by the second housing and is adapted to engage and move the PLR device in the lateral direction between a pre-staged configuration wherein movement of the primary lock is unrestricted by the PLR device and a fully-staged configuration wherein the primary lock is reinforced against movement.

The connector assembly of the preceding paragraph can optionally include, additionally and/or alternatively any one or more of the following features, configurations and/or additional components.

For example, in some embodiments the connector assembly may include a PLR actuator having an elongated finger with an inclined surface to provide a wedging action to move the PLR device as the second housing is mated with the first housing.

In some embodiments, the connector assembly may provide a PLR device that is laterally moved to the fully staged configuration before the first and second wire terminals are mated together.

In some embodiments, the connector assembly may provide a primary lock as a deflectable beam having a free distal end. In yet other embodiments, the free distal end of the primary lock engages an aperture within the first wire terminal.

In some embodiments, the connector assembly may include a blocking projection that is positioned in a primary lock deflection zone of the deflectable beam when the PLR device is in the fully staged configuration.

In some embodiments, the connector assembly includes a blocking projection having a length dimension measured in the mating direction that is more than 60% of a projected length of the deflectable beam.

In some embodiments, the PLR device further includes a plurality of flexible latches aligned to engage a plurality of elongated slots in the first housing.

In some embodiments, the connector assembly provides a plurality of elongated slots each including an enlarged end portion positioned toward one of the sides of the first housing, with the plurality of flexible latches being sized to pass through the plurality of elongated slots when the plurality of flexible latches is aligned with the enlarged end portions of the plurality of elongated slots.

In some embodiments, the connector assembly includes a plurality of elongated slots each including a narrowed portion opposite the enlarged end portions, with the plurality of flexible latches being blocked from passage into the plurality of elongated slots by the narrowed portions.

According to another aspect, a connector assembly may include a first wire terminal inserted into a first housing and held in place by a resilient primary lock and a primary lock reinforcement (PLR) device connected to the first housing and constrained against movement in a longitudinal direction relative to the first housing while permitting movement in a lateral direction relative to the first housing, with said PLR device including a blocking projection and configured to slide between a pre-staged configuration and a fully staged configuration. A second housing containing a PLR actuator is configured to engage and laterally move the PLR device between the pre-staged and fully staged configurations as the second housing is coupled to the first housing, wherein the blocking projection reinforces the primary lock against deflection when the PLR device is in the fully staged configuration.

The connector assembly of the preceding paragraph can optionally include, additionally and/or alternatively any one or more of the following features, configurations and/or additional components.

For example, in some embodiments the connector assembly includes a PLR actuator with an elongated finger having an inclined surface configured to provide a wedging action to move the PLR device as the second housing is mated with the first housing.

In some embodiments, the connector assembly may include a PLR device which is laterally moved to the fully staged configuration before the first wire terminal is mated with a second wire terminal in the second housing.

In some embodiments, the connector assembly includes a primary lock configured as a deflectable beam having a free distal end. In some embodiments, the connector assembly includes a blocking projection positioned in a primary lock deflection zone of the deflectable beam when the PLR device is in the fully staged configuration.

In some embodiments, the connector assembly includes a blocking projection having a length dimension measured in the mating direction that is more than 60% of a projected length of the deflectable beam.

In some embodiments, the connector assembly provides a PLR device with a plurality of flexible latches aligned to engage a plurality of elongated slots in the first housing.

In some embodiments, the connector assembly may include a plurality of elongated slots each including an enlarged end portion positioned toward one of the sides of the first housing, with the plurality of flexible latches being sized to pass through the plurality of elongated slots when the plurality of flexible latches is aligned with the enlarged end portions of the plurality of elongated slots.

In some embodiments, the connector assembly may include a plurality of elongated slots each including a narrowed portion opposite the enlarged end portions, with the plurality of flexible latches being blocked from passage into the plurality of elongated slots by the narrowed portions.

In yet another aspect, a connector assembly includes a first wire terminal held within a first housing via a resilient primary lock, and a primary lock reinforcement (PLR) device being slidably mounted within the first housing to allow movement of the PLR device in a lateral direction. A PLR actuator is carried by a second housing and engages the PLR device as the first housing is mated to the second housing, with the PLR actuator moving the PLR device between a pre-staged configuration and a fully staged configuration, and with the PLR device reinforcing the primary lock against movement when in the fully staged configuration.

The connector assembly of the preceding paragraph can optionally include, additionally and/or alternatively any, one or more of the following features, configurations and/or additional components.

For example, in some embodiments the connector assembly may include a PLR actuator having an elongated finger with an inclined surface providing a wedging action to move the PLR device as the second housing is mated with the first housing.

In some embodiments, the connector assembly includes a PLR device that is laterally moved to the fully staged configuration before the first wire terminal is mated with a second wire terminal in the second housing.

In some embodiments, the connector assembly includes a PLR device with a plurality of flexible latches aligned to engage a plurality of elongated slots in the first housing.

In yet another aspect, a method of reinforcing a primary lock of a connector assembly includes inserting a first wire terminal into a first housing, said first housing including a deflectable primary lock for securing the first wire terminal into the first housing, and a primary lock reinforcement (PLR) device having a blocking projection, then engaging and deflecting the primary lock as the first wire terminal is inserted into the first housing, then connecting a second housing to the first housing, with said second housing including a PLR actuator that engages the PLR device, and then wedging the PLR device with the PLR actuator to move the PLR device in a lateral direction as the second housing is connected to the first housing, with the blocking projection being laterally moved to reinforce the primary lock against deflection.

The method of the preceding paragraph can optionally include, additionally and/or alternatively any, one or more of the following features, configurations and/or additional components.

For example, tin some embodiments the method may include a PLR device moving to reinforce the primary lock against deflection prior to the first wire terminal being connected to a second wire terminal of the second housing.

In some embodiments, the method may include a PLR actuator with an elongated finger and an inclined surface that is wedged between the PLR device and the first housing.

The invention claimed is:

1. A connector assembly comprising:

a first wire terminal carried by a first housing having a mating end;

a resilient primary lock having a distal end adapted to secure the first wire terminal within the first housing;

a primary lock reinforcement (PLR) device secured within the first housing and including a blocking projection, with said PLR device being constrained to prevent movement in a longitudinal direction while allowing movement in a lateral direction;

a second wire terminal carried by a second housing and adapted to mate with the mating end of the first wire terminal; and a PLR actuator carried by the second housing and adapted to engage and move the PLR device in the lateral direction between a pre-staged configuration wherein movement of the primary lock is unrestricted by the PLR device and a fully staged configuration wherein the primary lock is reinforced against movement.

2. The connector assembly of claim 1 wherein the PLR actuator includes an elongated finger including an inclined surface, thereby providing a wedging action to move the PLR device as the second housing is mated with the first housing.

3. The connector assembly of claim 2 wherein the PLR device is laterally moved to the fully staged configuration before the first and second wire terminals are mated together.

4. The connector assembly of claim 1 wherein the primary lock is a deflectable beam having a free distal end.

5. The connector assembly of claim 4 wherein the distal end of the primary lock engages an aperture within the first wire terminal.

6. The connector assembly of claim 4 wherein the blocking projection is positioned in a primary lock deflection zone of the deflectable beam when the PLR device is in the fully staged configuration.

7. The connector assembly of claim 4 wherein the blocking projection has a length dimension measured in the mating direction that is more than 60% of a projected length of the deflectable beam.

8. The connector assembly of claim 1 wherein the PLR device further includes a plurality of flexible latches aligned to engage a plurality of elongated slots in the first housing.

9. The connector assembly of claim 8 wherein each of the plurality of elongated slots include an enlarged end portion positioned toward one of the sides of the first housing, with the plurality of flexible latches being sized to pass through the plurality of elongated slots when the plurality of flexible latches is aligned with the enlarged end portions of the plurality of elongated slots.

10. The connector assembly of claim 9 wherein each of the plurality of elongated slots include a narrowed portion opposite the enlarged end portions, with the plurality of flexible latches being blocked from passage into the plurality of elongated slots by the narrowed portions.

11. A connector assembly comprising:

a first wire terminal inserted into a first housing and held in place by a resilient primary lock;

a primary lock reinforcement (PLR) device connected to the first housing and constrained against movement in a longitudinal direction relative to the first housing while permitting movement in a lateral direction relative to the first housing, with said PLR device including a blocking projection and configured to slide between a pre-staged configuration and a fully staged configuration; and a second housing containing a PLR actuator configured to engage and laterally move the PLR device between the pre-staged and fully staged configurations as the second housing is coupled to the first housing, wherein the blocking projection reinforces the primary lock against deflection when the PLR device is in the fully staged configuration.

12. The connector assembly of claim 11 wherein the PLR actuator includes an elongated finger including an inclined surface configured to provide a wedging action to move the PLR device as the second housing is mated with the first housing.

13. The connector assembly of claim 12 wherein the PLR device is laterally moved to the fully staged configuration before the first wire terminal is mated with a second wire terminal in the second housing.

14. The connector assembly of claim 11 wherein the primary lock is a deflectable beam having a free distal end.

15. The connector assembly of claim 14 wherein the blocking projection is positioned in a primary lock deflection zone of the deflectable beam when the PLR device is in the fully staged configuration.

16. The connector assembly of claim 14 wherein the blocking projection has a length dimension measured in the mating direction that is more than 60% of a projected length of the deflectable beam.

17. The connector assembly of claim 11 wherein the PLR device further includes a plurality of flexible latches aligned to engage a plurality of elongated slots in the first housing.

18. The connector assembly of claim 17 wherein each of the plurality of elongated slots include an enlarged end portion positioned toward one of the sides of the first housing, with the plurality of flexible latches being sized to pass through the plurality of elongated slots when the plurality of flexible latches is aligned with the enlarged end portions of the plurality of elongated slots.

19. The connector assembly of claim 18 wherein each of the plurality of elongated slots include a narrowed portion opposite the enlarged end portions, with the plurality of flexible latches being blocked from passage into the plurality of elongated slots by the narrowed portions.

20. A connector assembly comprising:

a first wire terminal held within a first housing via a resilient primary lock;

a primary lock reinforcement (PLR) device being slidably mounted within the first housing to allow movement of the PLR device in a lateral direction; and a PLR actuator carried by a second housing and engaging the PLR device as the first housing is mated to the second housing, with the PLR actuator moving the PLR device between a pre-staged configuration and a fully staged configuration, and with the PLR device reinforcing the primary lock against movement when in the fully staged configuration.

21. The connector assembly of claim 20 wherein the PLR actuator includes an elongated finger including an inclined surface providing a wedging action to move the PLR device as the second housing is mated with the first housing.

22. The connector assembly of claim 20 wherein the PLR device is laterally moved to the fully staged configuration before the first wire terminal is mated with a second wire terminal in the second housing.

23. The connector assembly of claim 21 wherein the PLR device further includes a plurality of flexible latches aligned to engage a plurality of elongated slots in the first housing.

24. A method of reinforcing a primary lock of a connector assembly, said method comprising:

inserting a first wire terminal into a first housing, said first housing including a deflectable primary lock for securing the first wire terminal into the first housing, and a primary lock reinforcement (PLR) device having a blocking projection;

engaging and deflecting the primary lock as the first wire terminal is inserted into the first housing;

connecting a second housing to the first housing, with said second housing including a PLR actuator that engages the PLR device; and wedging the PLR device with the PLR actuator to move the PLR device in a lateral direction as the second housing is connected to the first housing, with the blocking projection being laterally moved to reinforce the primary lock against deflection.

25. The method of claim 24 wherein the PLR device is moved to reinforce the primary lock against deflection prior to the first wire terminal being connected to a second wire terminal of the second housing.

26. The method of claim 25 wherein the PLR actuator includes an elongated finger with an inclined surface that is wedged between the PLR device and the first housing.

* * * * *